US007395984B2

(12) United States Patent
Szarkowski et al.

(10) Patent No.: US 7,395,984 B2
(45) Date of Patent: Jul. 8, 2008

(54) SAFETY TETHER FOR HAND TOOLS

(75) Inventors: Tadeusz C. Szarkowski, Chicago, IL (US); Donald J. Zito, Fox River Grove, IL (US); Michael P. Mackin, Chicago, IL (US)

(73) Assignee: Woodhead Industries, Inc., Lisle, IL (US)

( * ) Notice: Subject to any disclaimer, the term of this patent is extended or adjusted under 35 U.S.C. 154(b) by 312 days.

(21) Appl. No.: 11/339,421

(22) Filed: Jan. 25, 2006

(65) Prior Publication Data

US 2006/0163412 A1 Jul. 27, 2006

Related U.S. Application Data

(60) Provisional application No. 60/647,497, filed on Jan. 27, 2005.

(51) Int. Cl.
*B65H 75/48* (2006.01)
*A62B 35/00* (2006.01)

(52) U.S. Cl. ..... 242/384

(58) Field of Classification Search ..... 242/382, 242/396.1, 382.5, 396.4, 384.5, 396.2, 384, 242/382.6; 188/82.1, 82.3, 82.34, 82.4, 82.7, 188/196 F, 265; 182/234, 231, 232, 237, 182/236, 239; 16/195, 198, 201; 267/154, 267/26, 275, 155, 284
See application file for complete search history.

(56) References Cited

U.S. PATENT DOCUMENTS 4,511,123 A * 4/1985 Ostrobrod ..... 254/364
5,351,906 A * 10/1994 Feathers ..... 242/396.6
5,447,280 A * 9/1995 Feathers ..... 242/381.5
5,722,612 A * 3/1998 Feathers ..... 242/381.5
5,771,993 A * 6/1998 Anderson et al. ..... 182/239
7,210,645 B2 * 5/2007 Paterson et al. ..... 242/383.4

* cited by examiner

*Primary Examiner*—Peter M. Cuomo
*Assistant Examiner*—William E Dondero
(74) *Attorney, Agent, or Firm*—Wildman, Harrold, Allen & Dixon LLP

(57) ABSTRACT

A safety device for hand tools includes a casing having a first clasp secured to the casing for mounting to the tool. A second clasp is mounted to a retractable cable connected to a constant tension cable reel mounted within the casing: The cable is payed out of and retracted into the bottom of the housing in its normal use position, and the second clasp is attached to a fixed support or "lock point" located below the normal working height of the tool. In use, when the tool is held by a worker and the housing is upright, a lock plate is disengaged from a ratchet plate fixed to the retractable reel so the tool is freely moveable relative to the lock point and easily maneuvered. If the tool is dropped, the reel retracts the cable as the tool begins to fall. The device is inverted as it falls below the lock point. As the device turns over, the lock plate shifts under gravity, and the weight of the tool places the cable in tension and tries to counter-rotate the hub, thus causing the lock plate to rapidly engage the ratchet plate and lock the reel, preventing further cable pay out and securing the tool before it strikes the floor or ground.

6 Claims, 4 Drawing Sheets

SAFETY TETHER FOR HAND TOOLS

RELATED APPLICATION

This application claims benefit of the priority filing of U.S. Provisional Application Ser. No. 60/647,497 filed on Jan. 27, 2005 for "SAFETY TETHER FOR HAND TOOLS".

FIELD OF THE INVENTION

The present invention relates to a safety device for hand tools; and more particularly, it relates to a safety device for the type of hand tools typically used in the construction industry and other applications in which a worker may use the tool at levels above the shoulders of the user, and even at full arm's length above the user's head. If the tool were to fall from such a height and strike the floor, the impact could cause damage to the tool and/or any object struck by it.

Hand tools of the type with which the present invention is concerned, include drills, electrically driven screw drivers, reciprocating chisels and the like. Some of these tools may weigh up to ten pounds; and they are used in a wide variety of work situations. In some cases, the worker may be on a ladder and working at shoulder level or above. In other cases, the worker may be on his feet and operating the tool at a level near or above his head. Obviously, the impact on a tool falling from a height of six feet or more, and colliding with an industrial surface, such as concrete, can cause severe damage to the tool. In cases where the worker is working above a surface, such as marble or wood, the surface itself could be damaged by a tool impact resulting from a fall at these heights. Hand tools of this type, particularly those of industrial or professional grade, are expensive to repair or replace. Moreover, such a fall, if unchecked, could result in injury. Further, time is lost in locating a replacement tool if the fallen tool is damaged to the point where it cannot operate.

It is thus desirable to provide some means for arresting the fall of hand tools under normal use conditions such that the tools are not damaged, personnel are protected from falling tools over substantial vertical distances, and surrounding environments are protected against damage; and it is desirable that this be done without unduly restricting the maneuverability of the tool or constrain the movements of the worker.

SUMMARY OF THE INVENTION

The present invention provides a safety device in the form of a tether for hand tools. The device includes a casing (which could be a casing of the tool itself since the device could be incorporated into the tool itself) which houses a retractable cable reel having a spring (preferably, though not necessarily a constant tension spring) coupled to a flexible cable. The cable is attached to a fixed support (called the "lock point") while the opposing end of the casing is releasably attached to the tool. As the cable is withdrawn from the casing to maneuver the tool, the spring unwinds but exerts a retraction force on the cable to retract the cable when the tool is placed closer to the lock point. The distal end of the cable is provided with a clasp which is adapted to be connected to the fixed support, such as a ladder, a bench top located at hip level or higher, or the worker's tool belt, for example, thus providing the lock point.

The tension on the retractable cable is constant and such that the worker may readily maneuver the tool. The cable extends or shortens without overt action by the user and without having to overcome a substantial retraction force.

The weight of the safety device is not substantial and does not add significantly to the weight of the tool. In short, the worker is not impeded substantially in the flexibility or utility of the tool, yet the tool users and surroundings are protected.

The retractable reel securing the cable includes a hub which is provided with a plate which contains ratchet teeth on its periphery, and the ratchet plate rotates in opposite directions as the cable is extended or retracted.

Inside the casing, a sliding lock plate is located beneath the ratchet plate of the retractable cable in the normal use (or upright) position, and has a configuration and teeth corresponding to the teeth of the ratchet plate, which are asymmetrical (preferably a sawtooth configuration) to prevent cable payout when the lock plate engages the hub in the inverted position of the casing. When the casing is in an upright position (that is, the tool clasp is located above the lock point at which the cable clasp is attached), the lock plate is disengaged from the ratchet plate of the retractable reel by gravity, thereby permitting unimpeded use of the tool.

Should the tool fall, as it is falling toward the horizontal level of the lock point, the reel retracts the cable, shortening the distance below which the tool may fall. As the tool falls sufficiently past this horizontal level of the lock point, the cable, acting as a tether, causes the casing to invert. This rotation, in turn, causes the lock plate to fall under gravity relative to the retractable reel. The spring continues to exert a retracting force on the cable, and the cable continues to rewind until the tool falls to the level at which the tool tries to extend the cable against the force of the spring. At this point the reel attempts to rotate in a counter direction and the weight of the tool firmly locks the reel against any further extension of the cable. The lock plate is restrained against rotation in the casing of the device, and this prevents any further extension of the cable and halts the downward movement of the tool because the distal end of the cable is latched to a rigid support (at the lock point).

The present invention provides a reliable, fast-acting, economical and light-weight safety tether or device for hand tools actuated by the fall itself, and preventing damage as well as injury.

Other features of the present invention will be apparent to persons skilled in the art from the following detailed description of a preferred embodiment accompanied by the drawing wherein identical reference numerals will be used to refer to like parts in the various views.

DETAILED DESCRIPTION OF THE ILLUSTRATED EMBODIMENT

Figure 1:
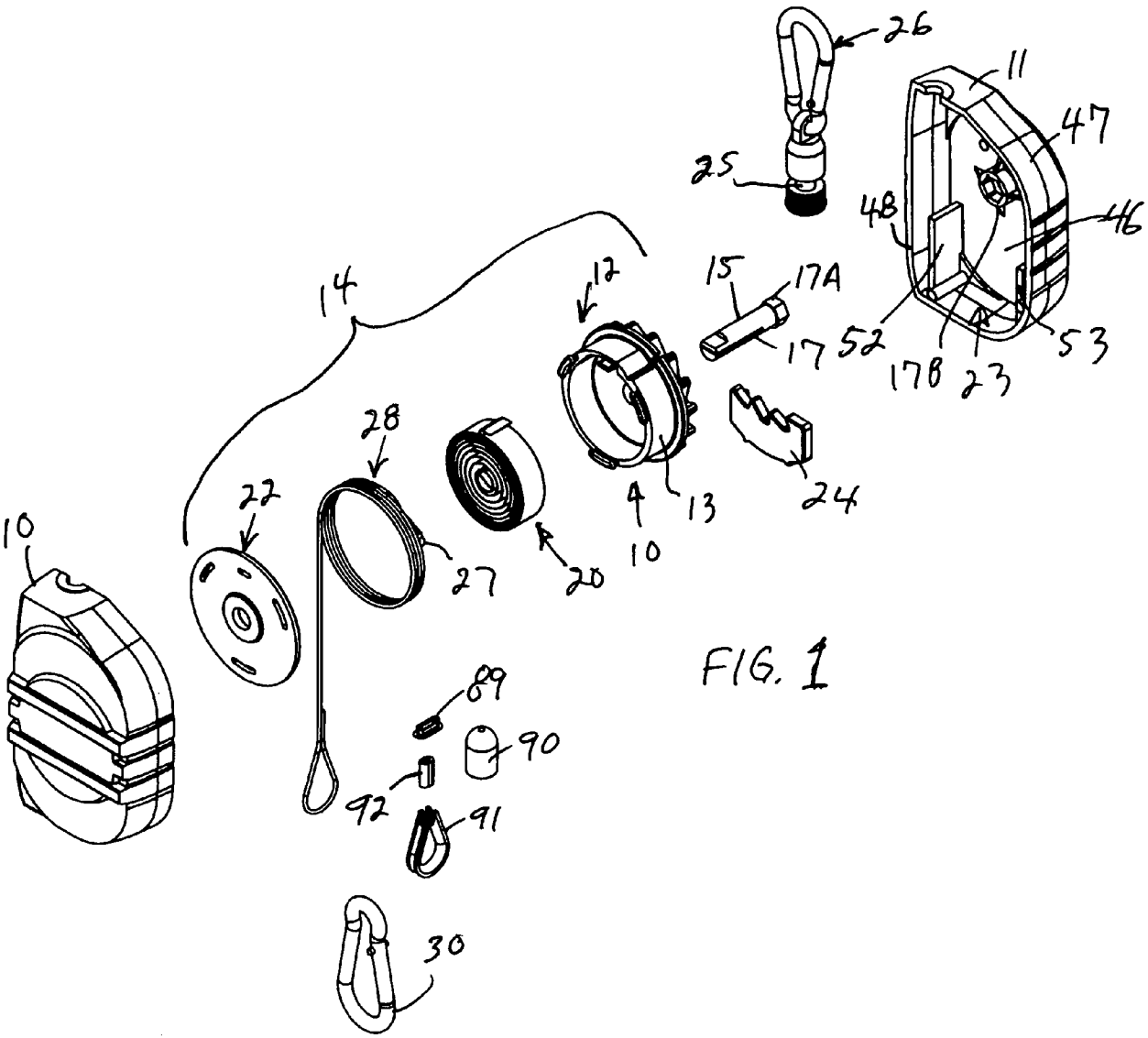
FIG. 1 is an upper isometric view of the tool safety device of the present invention with the major components in exploded relation.
Figure 2:
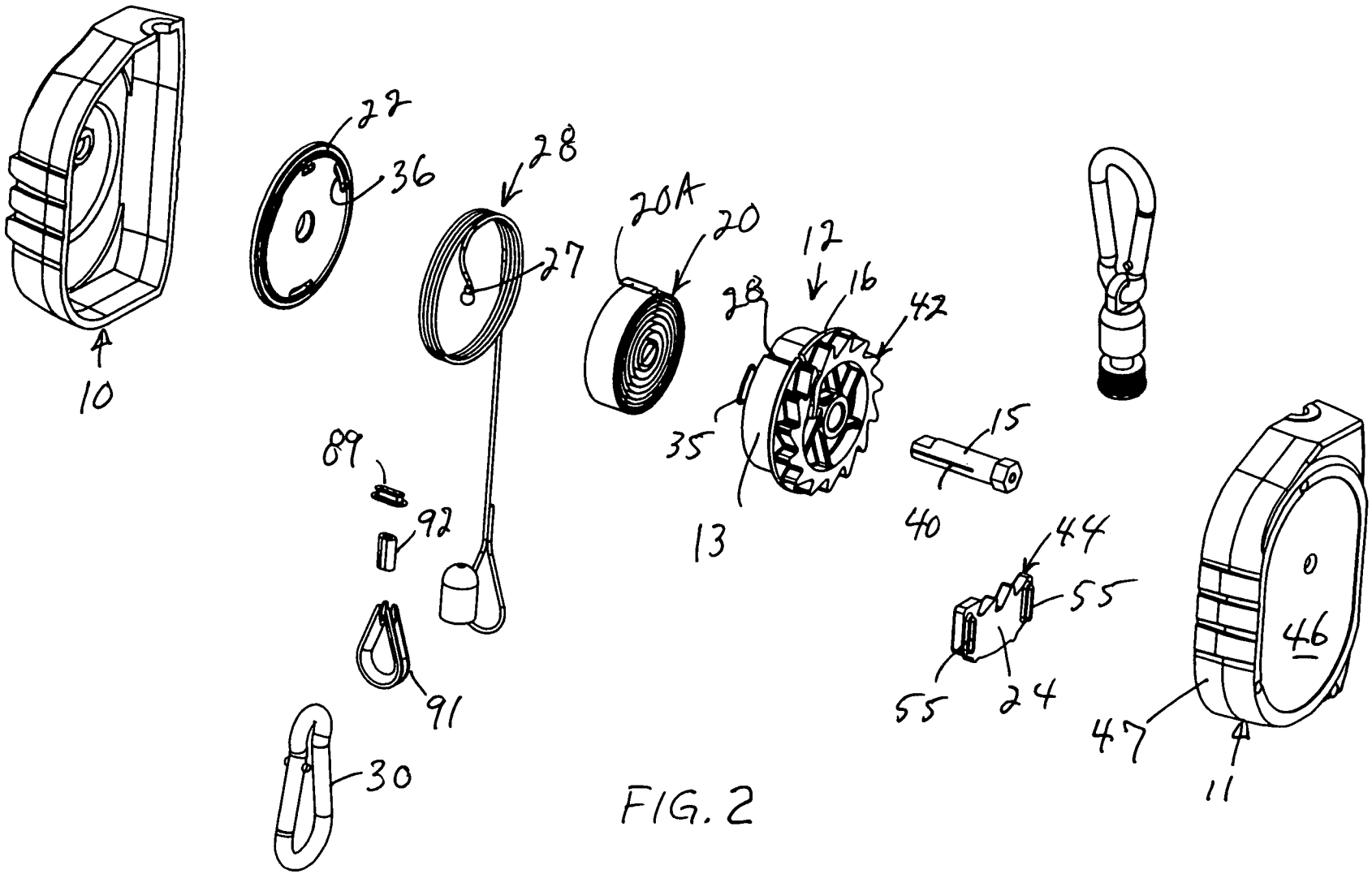
FIG. 2 is an upper isometric view of the device of FIG. 1 from the same side as FIG. 1, but looking in an opposing direction.

Referring to FIGS. 1 and 2, reference numerals 10 and 11 respectively designate first and second housing sections which cooperate to form a casing or outer housing. For convenience, and as will be better understood from the following description, the first housing section 10 is sometimes referred to as the left or spool housing; and the second housing section 11 is sometimes referred to as the right or ratchet housing. Housing sections 10, 11 cooperate to provide an outer housing 19 (FIG. 5) enclosing the cable reel and lock plate.

The two housing sections 10, 11 differ in some interior structure, but their peripheries are mirror images of one another, and they are designed with engaging edges to form a closed casing which encloses a retractable cable reel generally designated 14 and which is mounted on a shaft 15, the ends of which are mounted respectively to the spool housing section 10 and the ratchet housing section 11, as further described below.

Cable reel 14 includes a hub 12 comprising a cylindrical wall 13 and a ratchet plate 16, forming a spool 18 which houses a constant-tension spring 20 coiled within the spool 18, and a cover plate 22 which serves as an end plate for the spool, whereas the ratchet plate 16 acts as the opposing end plate for the spool. The end plates 22, 16 maintain the spring within the housing formed by the spool 18, while permitting the spring 20 to exert a retraction (i.e. rewind) force on the cable 28 wrapped about the hub 12, as will be described.

Figure 5:
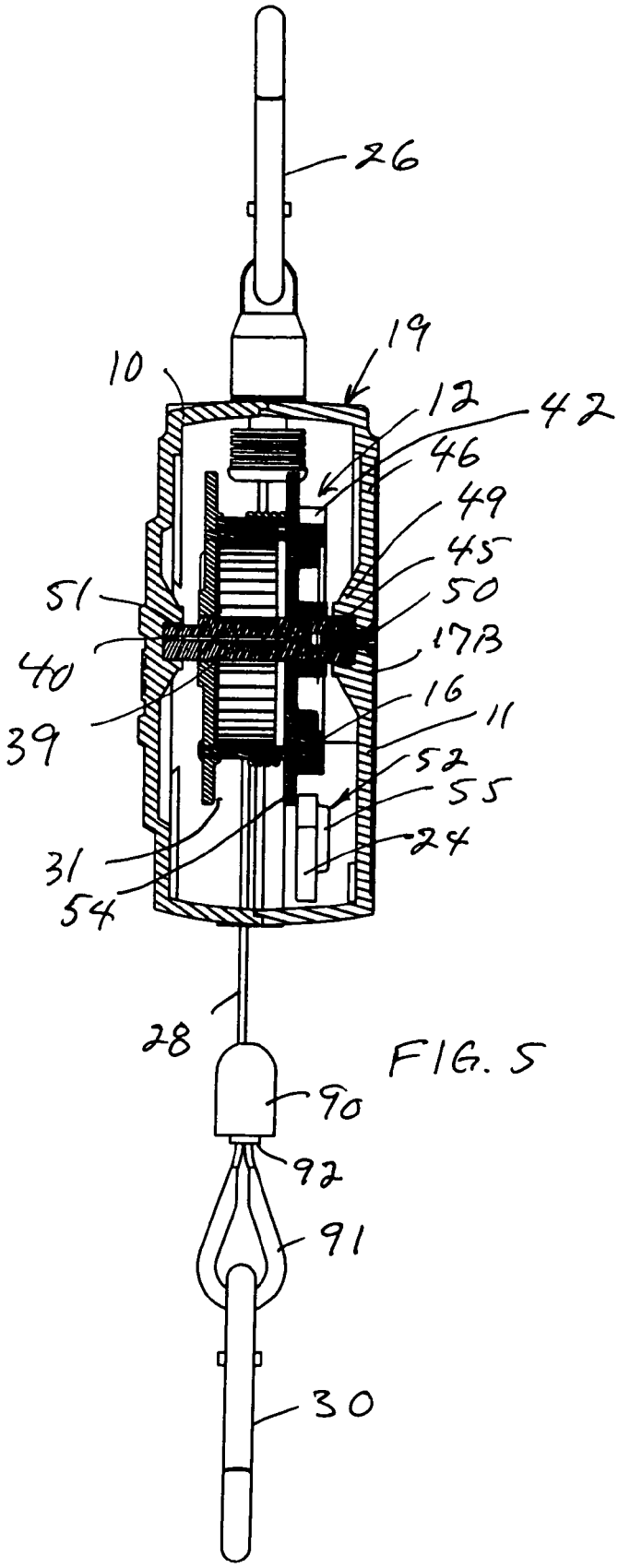
FIG. 5 is a vertical sectional view of the device of FIG. 1 along sight line 5-5 of FIG. 3.

A lock plate 24 is located within the housing sections 10, 11 in such a manner, as will be described, that it may freely slide in a radial (upward in FIG. 1) direction relative to the reel when the outer housing 19 is inverted—that is, in a plane generally perpendicular to the axis of shaft 15 (which axis defines the "axial" direction). Moreover, a slot 23 or receptacle in which the lock plate 24 is slidably received and guided is formed by cooperating structure of the housing section 11 and the ratchet plate 16 such that the lock plate 24 is free to slide in a radial plane aligned with the plane of (and guided by) the ratchet plate 16, as can be seen in FIG. 5 and will be further understood from subsequent description.

A first attachment device in the form of an openable clasp 26 is secured by means of an annular recess 25 (FIG. 1) in the base of the clasp, to the top of the casing formed by the housing sections 10, 11 when they are assembled. Clasp 26 provides an attachment device for reasonably securing the safety device to the tool sought to be protected against damage, which is not shown for brevity. Other tool attachment devices are readily available; or the retractable reel mechanism could be housed in the tool itself, thereby obviating the need for the tool clasp 26 and independent casing sections 10, 11.

Flexible cable (including wire, coated wire strand or cloth cord) 28 forms a tether and is wound about the outer surface cylindrical wall 13 of the hub 12. An inner or proximal end 27 of the cable 28 is secured to the hub 18, and thus to the outer or distal end of the spring 20, as is known in the art of retractable cable reels. Thus, the spring biases the cable to be wound about the hub 12 thereby tending to retract the cable into the housing, while permitting the cable to be extended with little effort as long as the hub is free to rotate. The inner end of the spring 20 is fixed to a splice 17 in the shaft 15, which shaft is constrained against rotation. The right end of the shaft 15 is formed into a hex head 17A which is received in a corresponding hex recess 17B formed in right housing section 11. A cable clasp or clamp generally designated 30 is secured to the distal end 29 of cable 28.

Before describing the structure in greater detail, a better understanding of the device and its operation may be obtained, it is believed, by a general description.

When the first and second housing sections 10, 11 are assembled together and secured by the shaft 15 (FIG. 5), they form a casing or outer housing for the retractable cable reel 14 which is free to rotate on the shaft 15. The inner end of the spring 20 is secured to the fixed shaft 15, which is secured against rotation to the housing sections 10, 11 by the hex head 17A in recess 17B. Alternatively, the shaft 15 could be formed integrally with one or both sidewalls of the housing, as persons familiar with the art with appreciate.

The cable 28 is wrapped around the cylindrical surface 13 of the spool 18 and has its proximal end 27 fixed to the distal end of the spring 20, as described. The spring 20 is a constant tension spring—that is, it exerts a substantially constant retraction force (clockwise in FIG. 1) on the cable 28 substantially independent of the length of the cable 28 which is retracted or payed out from the casing. The remainder of the cable is wound about the outer surface of the cylindrical wall 13 of spool 18, as mentioned, and the cable 28 extends through the bottom of the casing as viewed in FIG. 1, preferably through a brass eyelet.

In use, the clasp 26 (and thus the outer housing 19) is secured to a tool desired to be protected as described; and the cable clasp 30 is attached to a support. The support may be a rigid structure such as a hook on a ladder or on a bench, or it may be attached to the tool belt or other suitable location on the person performing the work and using the tool.

In this example, it is assumed that the tool is being used at an elevation above the attachment point of the cable clasp 30, this point sometimes being referred to as the lock point.

Figure 3:
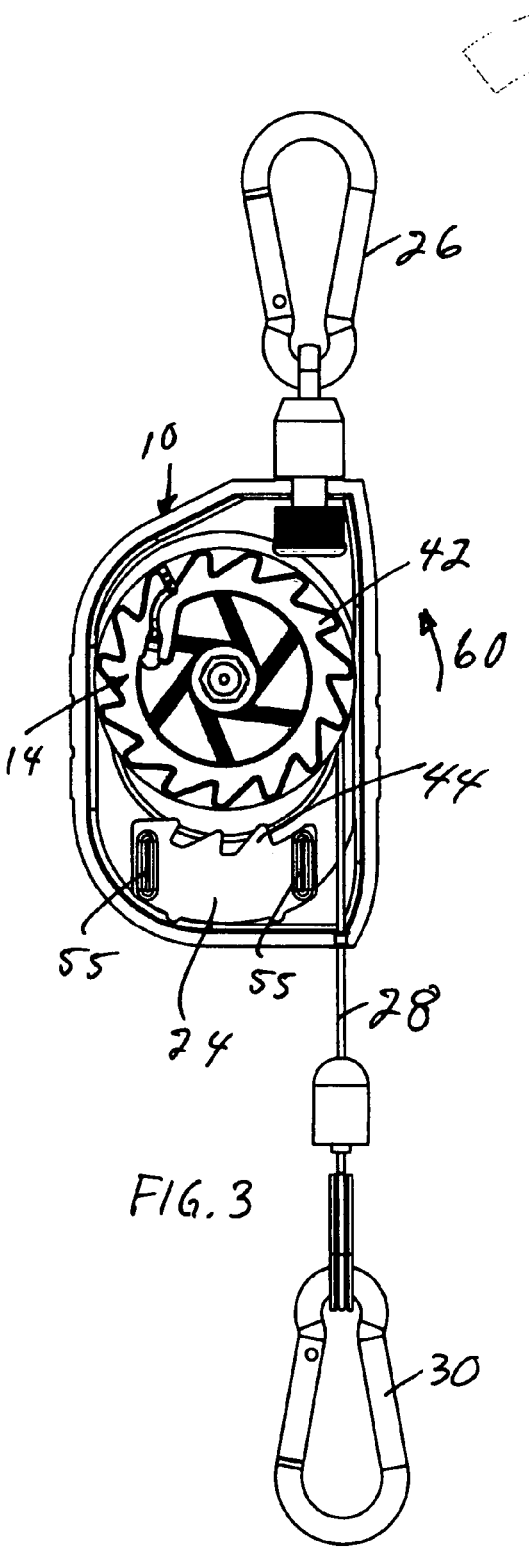
FIG. 3 is a side vertical view of the device of FIG. 1 in assembled relation with the right (i.e., ratchet) housing member removed and with the device in the normal upright use position, showing the lock plate disengaged from the ratchet plate.

In the normal use position, the outer housing 19 is upright in that the lock plate 24 is disengaged from the cable reel 14 (see FIG. 3). The cable 28 may be readily extended as the tool and housing 11 are elevated, and similarly, the cable is be retracted within the spool as the tool (and tether device) are lowered, permitting the worker to maneuver the tool as needed, and shortening the length of the extended portion of the cable.

Figure 4:
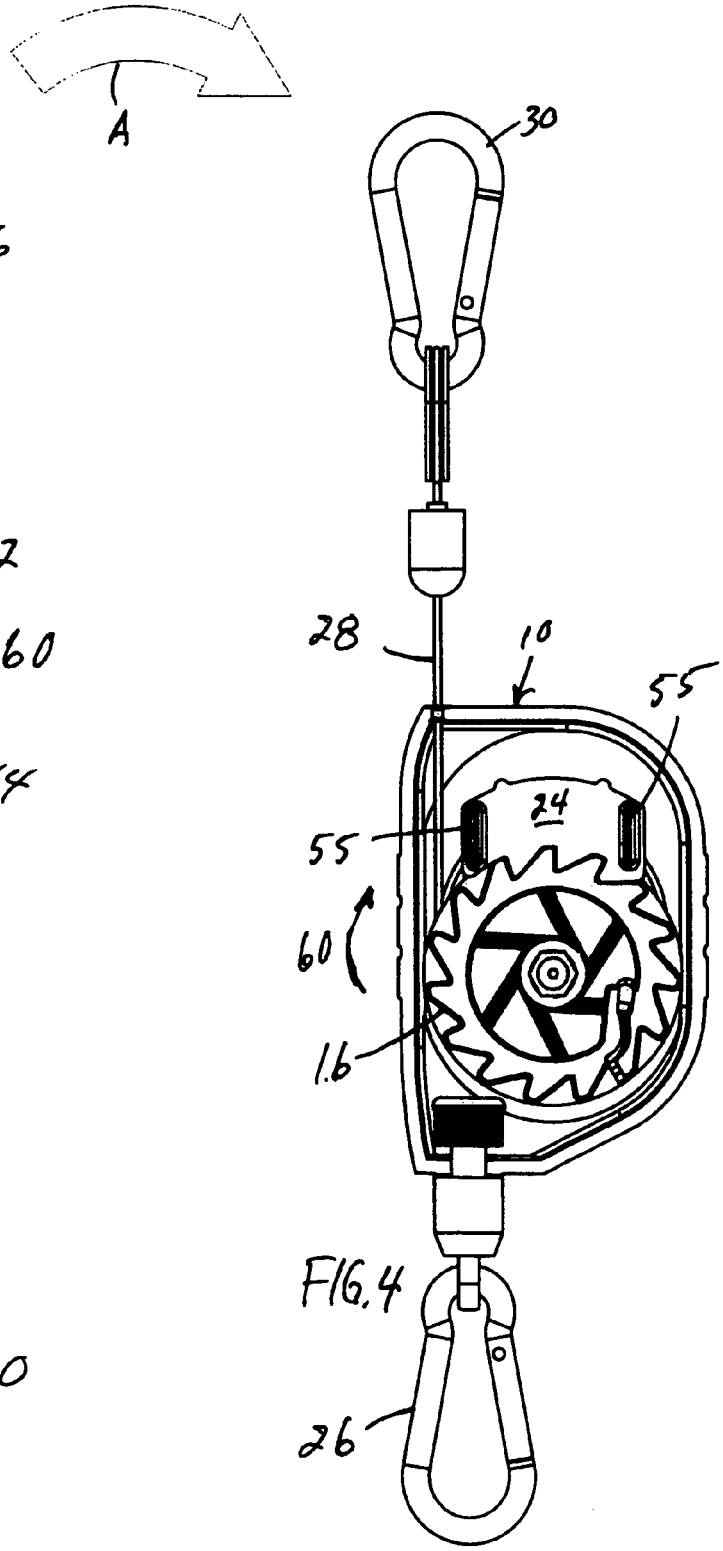
FIG. 4 is a view similar to FIG. 3, with the device inverted and showing the lock plate engaging the ratchet plate and securing the cable reel.

If the tool should be dropped or otherwise fall from its location above the lock point, the initial movement of the tool and casing would be comparatively slow and the cable will retract automatically onto the spool and become shortened as the elevation of the tool approaches the elevation of the lock point (that is, as the vertical distance between the tool and the lock point becomes shorter). As the tool drops below the elevation of the lock point, the casing inverts so that the lock plate 24 is now above the ratchet plate 16, but the two are still aligned, compare FIGS. 3 and 4. Thus, as the device inverts, the lock plate 24 falls a short distance radially inward (downward) relative to the position of the axis of the shaft 15 in the inverted position (FIG. 4). The lock plate 24 engages and locks the ratchet plate 16, preventing further rotation of the cable reel 14 in the "unwind" or "pay out" direction, thus securing the tool to the lock point at a shorter vertical displacement than the starting length of the unwound portion of the cable—i.e. typically substantially less than the original distance at which the tool was being used above the lock point, and avoiding a damaging impact to the tool or surroundings, that otherwise might have occurred.

Still referring to FIGS. 1 and 2, it will be observed that FIG. 1 is an upper perspective view, with the major components in exploded relation, looking into the interior of the ratchet housing section 11, whereas FIG. 2 is a similar view, but looking into the interior of the spool housing section 10. Turning then to the drawing, the spool or hub 12 includes the cylindrical side wall 13 which is rigidly affixed to the ratchet plate 16 and houses the spring 20. The outer end of spring 20 is turned over at 20A and fits into a recessed slit 20B in the cylindrical wall 13 to anchor the spring. The side wall 13 includes a number of tabs 35 which originally extend in an axial direction, and are received in corresponding slots 36 formed in the spool cover 22, and then bent inwardly to secure the spool cover 22 to the hub 12 and, in cooperation with the solid ratchet plate 16, to form an enclosure for the coiled spring 20.

The spring 20 is a flat metal spring of the type known as "constant tension", and has a proximal or inner end is bent inwardly at 39 (FIG. 5) and received in a retaining slot 40 formed in the shaft 15. As described, the shaft 15 is fixed relative to the housing sections 10, 11, thus the proximal or inner end 39 of the spring 20 is also fixed or attached to the casing.

The peripheries of the ratchet plate 16 and the spool cover 22 extend radially beyond the circumferential side wall 13 of the spool 18, thus cooperating with cover 22 to form a circumferential recess 31 (FIG. 5) for receiving the flexible cable 28 as it is wrapped around the outer surface of the cylindrical wall 13 between the ends of the spool thus formed.

The outer (right) surface of the ratchet plate 16 (FIG. 5) is formed into a series of teeth 42, each tooth being asymmetrical, generally in the form of a sawtooth, and formed to fit into mating sawtooth recesses in a correspondingly formed upper edge 44 of the lock plate 24 so that when the two are engaged, the spool cannot rotate in an unwind direction (clockwise in FIG. 4) relative to the lock plate 24 which, as will be understood, is fixed against rotation within the casing, although it may slide radially.

Turning now to the ratchet housing section 11 as seen in FIGS. 1, 2 and 5, it includes an end wall 46 and a side wall 47 extending about the perimeter and defining an edge 48. The inner center of end wall 46 is formed into a boss 49 which forms recess 17B having a hexagram interior shape and which receives the hex end of shaft 15 to prevent rotation of the shaft 15. A screw 50 is threaded into a tapped hole extending axially into the hex head 17A of the shaft 15 to secure the shaft to the right housing section 11. The spool housing section 11 may be molded of synthetic material such as plastic, or it may be metal for greater durability and strength.

Cable reel 12 is rotatably mounted on the shaft 15 (FIG. 5). A pair of opposing walls 52, 53 (FIG. 1) are formed in the interior of the ratchet housing section 11 and integral with the end wall 46 and peripheral side wall 47 for rigidity. The opposing walls 52, 53 are spaced to form receptacle 23 for the lock plate 24, permitting the lock plate to slide easily, but preventing the lock plate from rotating about an axis parallel to the shaft 15.

Laterally, the lock plate 24 is retained on its inner side by the peripheral edge 54 of the ratchet plate 16 (FIG. 5). On the outboard side of the lock plate 24, a pair of elongated bumpers 55, 55 are formed (FIGS. 2, 5) each provided with a rounded surface 55A (FIG. 5) to reduce friction. The spacing between the inner surface of the housing end wall 48 and the opposing circumferential surface of the outer edge 54 of the ratchet plate 16 is less than the combined width of the lock plate 24 and bumpers 55 so that when the device is inverted, the teeth 44 of the lock plate 24 are aligned with, and will engage the teeth 42 of the ratchet plate, as may be observed by comparing the free position of the lock plate 24 in FIG. 3 (in which the unit is upright) with the locked position of lock plate 24 in FIG. 4 (with the unit inverted). As seen in FIG. 2, the teeth 44 of the lock plate 24 are also in the form of a sawtooth and conform to, and mate with, the teeth 42 of the ratchet plate 16.

The left end of the shaft 15 (which is split as will be recalled) is pressed into an aligned opening 51 in a boss formed on the inner surface of the left side casing 10. It will be observed that the shaft 15 serves not only to mount the retractable cable reel assembly 14 for rotation, but the shaft 15 also provides a rigid connection for securing the two housing sections 10, 11 together forming a rigid casing for mounting and securing the interior components.

An eyelet 89 (FIG. 2) is placed in the bottom of the side wall 47 of the outer housing through which the cable 28 extends. The cable is also placed through a bumper 90 and around a thimble 91 which is coupled to the previously described swivel clamp or hook 30. The cable is fixed to the thimble 91 by swage 92.

Turning now to FIGS. 3 and 4, the release and locking positions of the sliding lock plate 24 are illustrated. It will be appreciated that FIGS. 3 and 4 are views looking into respectively the spool housing 10 (the ratchet housing 11 being removed), and that the portion of the casing for mounting the locking plate 24 which confines and guides the lock plate 24 (sometimes referred to as a receptacle) is not seen here because it is located in the ratchet housing section 11—i.e. walls 52 and 53 (see FIG. 1).

Turning then to FIG. 3, the spool housing 10 is seen in a first upright or normal use position. The tool is attached to the upper clasp 26 fixed to the top of the casing, and the clasp 30 which is connected to the distal end of cable 28 wound on the constant tension retractable cable reel 14, is attached to a fixed lock point preferably located beneath the range of normal operating height for the tool being protected. When the tool is being maneuvered, the cable 28 unwinds (i.e. extends from the position of FIG. 3) or retracts as needed; and the reel 16 is free to rotate, exerting a constant retraction force on the cable 28.

If the tool were to fall, initially reel 14 would normally tend to retract the cable 28 (i.e. reel 14 would rotate counter clockwise in the direction of the arrow 60 in FIG. 3). When the tool and safety device pass the horizontal plane of the lock point, the clasps invert, and so does the safety tether device, as illustrated diagrammatically by the large arrow A between FIGS. 3 and 4. In the inverted position, as illustrated in FIG. 4, it will be appreciated that the rewind direction for the reel is still clockwise, as the arrow 60 in FIG. 4 indicates. Thus, if there is slack in cable 28, the reel will retract the cable because in the rewind direction of rotation, the teeth of the reel 14 will override the teeth of the lock plate 24. However, when the weight of the tool tends to extend the cable 28 as the tool falls, the teeth of the lock plate interfere with, and lock the teeth of the reel, thus preventing further pay out of the cable. In practice, the weight of the tool provides sufficient force so that when the cable is retracted and the falling tool exerts a force on the cable tending to extend it, the rotation of the hub 12 is reversed quickly, and due to the asymmetrical shape of the tether on the lock plate 24 and ratchet plate 16, the two snap firmly and quickly into locking position to end the fall of the tool immediately. The lock plate 24, guided by the receptacle 23 in which it is slidably received, falls under gravity and engages the ratchet plate 16. The teeth 42, 44 engage and stop the rotation of the cable reel instantly. This arrests the fall of the tool and prevents impact with the floor or ground.

By clipping the clasp 26 (i.e. the one directly attached to the casing) to the worker (as at his or her belt), the inventive device can be used as a "parking" or personal retention. Moreover, by incorporating the reel, lock plate and cable into the tool casing, the clasp 26 and housing sections 10 and 11 may be omitted.

Having thus disclosed one embodiment, persons skilled in the art will be able to modify certain of the structure which has been disclosed and substitute equivalent elements for those illustrated while continuing to practice the principle of the invention. For example, the durability and strength of the device may be increased, thus a corresponding cost increase, for different applications. For example, the housing sections 10, 11 may be made of metal. Alternatively, the tool clasp 26 may be attached to a bracket mounted on the interior of the outer housing and supporting the cable reel 14 on a shaft carried by the bracket. The bracket, in turn, would serve as a mounting for the outer housing sections 10, 11. By using a metal bracket of this type, durability and strength can be improved. Moreover, as noted above, the outer housing sections 10, 11 could be the housing or casing for the tool itself, and this would eliminate the need for the tool clasp 26. It is thus intended that all such modifications and substitutions be covered as they are embraced within the spirit and scope of the appended claims.

We claim:

1. For use in combination with a tool, a tether device comprising:

a mounted shaft in association with said tool;

a retractable reel mounted for rotation on said shaft, said reel including, a hub defining a set of radially extending teeth;

a constant tension spring having a first end fixed to said shaft and a second end attached to said hub;

a cable having a first end attached to said hub and a second distal end for attachment to a lock point;

a lock plate having at least one tooth adapted to engage with said teeth of said hub and inhibit rotation of said hub when engaged, said lock plate mounted for sliding movement between a first disengagement position device in an upright position in which said lock plate is free of said hub and said hub is free to rotate about said shaft, and a second position when said device is inverted, to lockingly engage said hub to prevent rotation thereof; and a receptacle for holding and guiding said lock plate between said disengagement and engagement positions.

2. A tether device for a tool comprising:

a housing having a top and a bottom in an upright position for normal use, an attachment device secured to said top of said housing and adapted to be attached to a tool;

a shaft mounted in said housing;

a retractable reel mounted for rotation on said shaft, said reel including, a hub defining a set of radially extending teeth;

a constant tension spring having a first end fixed to said shaft and a second end attached to said hub;

a cable having a first end attached to said hub and a second end extending externally of said housing for attachment to a lock point;

a lock plate having at least one tooth adapted to engage with said teeth of said hub and inhibit rotation of said hub when engaged, said lock plate mounted within said housing for sliding movement between a first disengagement position when said housing is in an upright position in which said lock plate is free of said hub and said hub is free to rotate about said shaft, and a second position when said housing is inverted, to lockingly engage said hub to prevent rotation thereof;

said housing guiding said lock plate between said disengagement and engagement positions, while restraining said lock plate against rotation relative to said housing.

3. The device of claim 2 wherein said lock plate defines a plurality of teeth for engaging said teeth of said hub, and said teeth of said hub and said teeth of said lock plate are asymmetrical, wherein when said device is in a generally upright position, said hub is rotated in a direction to retract said cable and said teeth of said hub may override said teeth of said lock plate thereby continuing to retract said cable and shorten the length of said cable extended externally of said housing; and wherein as said device is inverted, the weight of said tool causes said hub to counter-rotate, thereby causing said lock plate to rapidly lockingly engage said hub.

4. The device of claim 3 wherein said housing includes a first and second housing sections enclosing said reel;

one of said housing sections defining a receptacle slidably receiving said lock plate while restraining rotation of said lock plate relative to said housing.

5. The device of claim 4 wherein said shaft is mounted to said first and second housing sections, one of said housing sections engaging an end of said shaft to prevent rotation of said shaft.

6. The device of claim 2 wherein said hub include a plate, a cylindrical wall fixed to said plate, and a set of teeth extending circumferentially about said plate, said lock plate positioned to engage said circumferential teeth in a first, locking position, said locking plate adapted for movement between said locking position and an unlocking position.

* * * * *